US011976898B2

(12) United States Patent
O'Connell et al.

(10) Patent No.: US 11,976,898 B2
(45) Date of Patent: May 7, 2024

(54) FIREARM HAND GRIP WITH CYLINDRICAL BODY

(71) Applicant: FALCON INDUSTRIES, INC., Moriarty, NM (US)

(72) Inventors: Xavier O'Connell, Tijeras, NM (US); Mira O'Connell, Tijeras, NM (US)

(73) Assignee: FALCON INDUSTRIES, INC., Moriarty, NM (US)

( * ) Notice: Subject to any disclaimer, the term of this patent is extended or adjusted under 35 U.S.C. 154(b) by 0 days.

(21) Appl. No.: 17/835,886

(22) Filed: Jun. 8, 2022

(65) Prior Publication Data

US 2023/0400280 A1 Dec. 14, 2023

(51) Int. Cl.
*F41C 23/16* (2006.01)

(52) U.S. Cl.
CPC ..... *F41C 23/16* (2013.01)

(58) Field of Classification Search
CPC ..... F41C 23/16; F41C 23/10; F41C 23/12; F41C 23/14
See application file for complete search history.

(56) References Cited

U.S. PATENT DOCUMENTS 3,164,920 A * 1/1965 Haas, Jr. ..... F41C 23/16 42/71.01
3,656,399 A * 4/1972 Hill ..... F42B 12/68 42/105
4,300,302 A * 11/1981 Anschutz ..... F41C 23/14 42/73
5,946,842 A * 9/1999 Nyzell ..... F41C 23/04 42/72
6,658,781 B1 * 12/2003 Bowen ..... F41C 23/16 42/72
6,854,205 B2 * 2/2005 Wikle ..... F41C 23/16 42/71.01
7,121,034 B2 * 10/2006 Keng ..... F41A 23/10 42/72

(Continued)

OTHER PUBLICATIONS

Install Video, between 15 and 20 second mark (https://www.facebook.com/MidEvilIndustries/videos/how-to-install-the-mid-evil-360-arg/1660165300811573/) (Year: 2020).*

(Continued)

*Primary Examiner* — Michelle Clement
(74) *Attorney, Agent, or Firm* — LOZA & LOZA, LLP; Richard H. Krukar

(57) ABSTRACT

A firearm hand grip can have a cylindrical body with grooves, digit ridges, and a digit rest. The grooves can be circumferential grooves completely encircling the cylindrical body and providing improved grip relative to a smooth surface. The digit ridges can be positioned to fit comfortably between a user's fingers while the digit rest supports the lowest finger. The hand grip's top section includes a right cheek, a left cheek, and a receiver interface. The top section can be used to attach the hand grip to a firearm and can be shaped to blend smoothly into a firearm receiver. The cylindrical body is between the top section and the bottom of the hand grip. The dimensions of the hand grip include the cylindrical body's outer diameter, digit ridge offset distance, and digit rest offset distance. The dimensions are selected to ensure user comfort while using the firearm.

20 Claims, 12 Drawing Sheets

(56) References Cited

U.S. PATENT DOCUMENTS 7,325,351 B1 * 2/2008 Leung ..... F41C 23/16 42/71.01
7,409,791 B2 * 8/2008 Moody ..... F41C 23/16 42/72
7,584,568 B1 * 9/2009 Brownlee ..... F41C 23/16 89/37.01
7,841,120 B2 * 11/2010 Teetzel ..... F41A 23/08 42/72
8,136,284 B2 * 3/2012 Moody ..... F41C 23/16 42/71.01
8,215,047 B2 * 7/2012 Ash, Jr. ..... F41C 23/14 42/71.01
8,341,864 B2 * 1/2013 Moody ..... G03B 17/561 42/72
8,341,865 B2 * 1/2013 Moody ..... F16M 13/04 42/72
8,356,542 B2 * 1/2013 Cottle ..... F41A 19/00 89/129.02
8,429,843 B2 * 4/2013 Yan ..... F41C 23/12 42/71.01
8,429,844 B2 * 4/2013 Dextraze ..... F41A 9/71 42/73
8,607,491 B2 * 12/2013 Moody ..... F41A 23/08 42/72
8,607,492 B2 * 12/2013 Hartley ..... F41C 23/16 42/72
8,752,323 B2 * 6/2014 Fulton ..... F41C 23/14 42/73
8,783,160 B2 * 7/2014 Hochstrate ..... F41A 5/18 89/193
8,839,544 B2 * 9/2014 Troy ..... F41C 23/16 42/72
8,857,094 B2 * 10/2014 Michel ..... F41C 23/10 42/71.01
9,239,203 B2 * 1/2016 Jarboe ..... F41A 3/18
9,441,910 B1 * 9/2016 Fogoros ..... F41C 23/14
9,573,268 B2 * 2/2017 Azhocar ..... B25G 1/06
9,709,356 B1 * 7/2017 Anstett ..... F41C 23/16
10,197,358 B2 * 2/2019 Hebden ..... F41C 23/16
10,337,813 B2 * 7/2019 Jonsson ..... F41A 3/66
10,502,365 B2 * 12/2019 Moody ..... G03B 17/563
10,527,387 B1 * 1/2020 Oliva Chavez ..... F41C 23/16
10,724,824 B1 * 7/2020 Lister ..... F41C 23/12
10,753,698 B2 * 8/2020 McInerney, III ..... F41A 19/10
10,801,793 B2 * 10/2020 Murphy, II ..... F41C 23/10
10,866,061 B2 * 12/2020 Anstett ..... F41C 23/16
10,866,062 B1 * 12/2020 Derousse ..... F41C 27/00
10,942,004 B2 * 3/2021 Grenier ..... F41C 23/16
11,112,208 B1 * 9/2021 Mantas ..... F41C 23/16
11,168,955 B2 * 11/2021 Walthert ..... F41B 5/1453
11,385,020 B2 * 7/2022 Grenier ..... F41C 23/14
11,499,797 B2 * 11/2022 Mantas ..... F41C 23/16
11,668,542 B2 * 6/2023 Walthert ..... F41B 5/123 124/88
2005/0241206 A1 * 11/2005 Teetzel ..... F41A 23/08 42/72
2009/0133309 A1 * 5/2009 Cahill ..... F41C 23/16 42/72
2009/0193702 A1 * 8/2009 Lin ..... F41C 23/16 42/72
2011/0179688 A1 * 7/2011 Ash, Jr. ..... F41C 23/14 42/72
2011/0283583 A1 * 11/2011 Freed ..... F41C 23/14 42/71.01
2012/0272557 A1 * 11/2012 Yan ..... F41C 23/16 42/72
2013/0014418 A1 * 1/2013 Dextraze ..... F41A 11/02 42/16
2013/0239450 A1 * 9/2013 Michel ..... F41C 23/14 29/434
2013/0340311 A1 * 12/2013 Marquez ..... F41C 7/00 42/72
2014/0075814 A1 * 3/2014 Larson ..... F41A 3/26 89/193
2016/0332290 A1 * 11/2016 Azhocar ..... F16M 11/14
2016/0332291 A1 * 11/2016 Azhocar ..... F16M 11/14
2021/0071981 A1 * 3/2021 Maffett ..... F41A 11/00
2022/0120525 A1 * 4/2022 Zung ..... F41A 17/22

OTHER PUBLICATIONS

Mid-Evil 360 ARG (https://web.archive.org/web/20210418000823/https://www.mid-evil.com/product/360-arg/) (Year: 2021).*
All Outdoor (https://www.alloutdoor.com/2021/06/30/mid-evil-industries-arg/) (Year: 2021).*

* cited by examiner

FIREARM HAND GRIP WITH CYLINDRICAL BODY

FIELD OF THE INVENTION

Embodiments are related to firearms, firearm replicas, firearm accessories, firearm grips, pistol grips for rifles, and to accessories for firearms in the M4 family.

BACKGROUND

The well-known AR-15 rifle was developed in the 1950s and is often considered the first rifle in the M4 family which also includes the M16, and a vast number of other firearm models. The firearms in the M4 family have standardized dimensions and easily replaceable, interchangeable, and upgradeable parts. Those easily replaceable, interchangeable, and upgradeable parts include rifle stocks, collapsible stocks, forward grips, pistol grips, buffer tubes, sights, trigger assemblies, and many other parts. As such, firearms in the M4 family are easily customized for specific tasks, form factors, and even cosmetics.

BRIEF SUMMARY

The following presents a summary of one or more aspects of the present disclosure, in order to provide a basic understanding of such aspects. This summary is not an extensive overview of all contemplated features of the disclosure and is intended neither to identify key or critical elements of all aspects of the disclosure nor to delineate the scope of any or all aspects of the disclosure. Its sole purpose is to present some concepts of one or more aspects of the disclosure as a prelude to the more detailed description that is presented later.

One aspect of the subject matter described in this disclosure can be implemented as a hand grip. The hand grip can include a cylindrical body, and a top section. The top section can include a right cheek, a left cheek, and a receiver interface. The hand grip can also include a grip screw hole in the receiver interface, and a bottom, wherein the receiver interface is between the right cheek and the left cheek, the cylindrical body is between the top section and the bottom, the grip screw hole is configured for a grip screw to pass through the grip screw hole, and the grip screw hole is configured for the grip screw to attach the hand grip to a firearm receiver.

Another aspect of the subject matter described in this disclosure can be implemented as a method. The method can include forming a monolithic hand grip that includes a cylindrical body, a top section, and a bottom, wherein the top section includes a right cheek, a left cheek, and a receiver interface. The receiver interface can include a grip screw hole, the receiver interface can be between the right cheek and the left cheek, the cylindrical body can be between the top section and the bottom, the grip screw hole can be configured for a grip screw to pass through the grip screw hole, and the grip screw hole can be configured for the grip screw to attach the monolithic hand grip to a firearm receiver.

Yet another aspect of the subject matter described in this disclosure can be implemented as a hand grip. The hand grip can include an attachment means for attaching the hand grip to a firearm, a cylindrical gripping means under the attachment means, an access means for accessing a grip screw attaching the hand grip to the firearm, and a digit resting means located at a bottom of the cylindrical gripping means, wherein the attachment means includes a blind hole that is configured for holding a safety detent spring of the firearm.

In some implementations of the methods and devices, a hand grip includes an access hole in a rear surface of the cylindrical body, wherein the access hole is configured to provide access to the grip screw. In some implementations of the methods and devices, the cylindrical body has an outer diameter that is greater than 1.25" and less than 1.55". In some implementations of the methods and devices, the cylindrical body has a circumferential groove that is at least 0.03" deep. In some implementations of the methods and devices, the hand grip includes a digit rest that is located at the bottom and on a front surface of the cylindrical body. In some implementations of the methods and devices, the top section includes a blind hole configured for holding a safety detent spring of a firearm.

In some implementations of the methods and devices, the cylindrical body includes a plurality of circumferential grooves. In some implementations of the methods and devices, the circumferential grooves are parallel. In some implementations of the methods and devices, one of the circumferential grooves passes completely around the cylindrical body. In some implementations of the methods and devices, the hand grip is a monolithic hand grip.

In some implementations of the methods and devices, the hand grip further includes a digit ridge, wherein the digit ridge is located between the bottom and the top section, and the digit ridge is located on a front surface of the cylindrical body. In some implementations of the methods and devices, the cylindrical body includes two parallel circumferential grooves, and the digit ridge is positioned between the two parallel circumferential grooves. In some implementations of the methods and devices, the digit ridge is equidistant between the two parallel circumferential grooves. In some implementations of the methods and devices, the hand grip is configured for attachment to an M4 family firearm. In some implementations of the methods and devices, the cylindrical body has an axis, a firearm has a bore line, and the handgrip is configured for attachment to the firearm with the axis of the cylindrical body perpendicular to the bore line.

In some implementations of the methods and devices, the cylindrical body includes a plurality of parallel circumferential grooves that completely encircle the cylindrical body. In some implementations of the methods and devices, the monolithic hand grip includes a digit rest that is located at the bottom and on a front surface of the cylindrical body.

In some implementations of the methods and devices, the hand grip further includes two parallel circumferential grooves in the cylindrical gripping means, and a digit ridge that is positioned between the two parallel circumferential grooves on a front surface of the cylindrical gripping means.

These and other aspects will become more fully understood upon a review of the detailed description, which follows. Other aspects, features, and embodiments will become apparent to those of ordinary skill in the art, upon reviewing the following description of specific, exemplary embodiments in conjunction with the accompanying figures. While features may be discussed relative to certain embodiments and figures below, all embodiments can include one or more of the advantageous features discussed herein. In other words, while one or more embodiments may be discussed as having certain advantageous features, one or more of such features may also be used in accordance with the various embodiments discussed herein. In similar fashion, while exemplary embodiments may be discussed below as device, system, or method embodiments such exemplary embodiments can be implemented in various devices, systems, and methods.

BRIEF DESCRIPTION OF THE DRAWINGS

The accompanying figures, in which like reference numerals refer to identical or functionally similar elements throughout the separate views and which are incorporated in and form a part of the specification, further illustrate aspects of embodiments and, together with the background, brief summary, and detailed description, serve to explain the principles of the present invention. The figures are not necessarily to scale.

DETAILED DESCRIPTION

Figure 1:
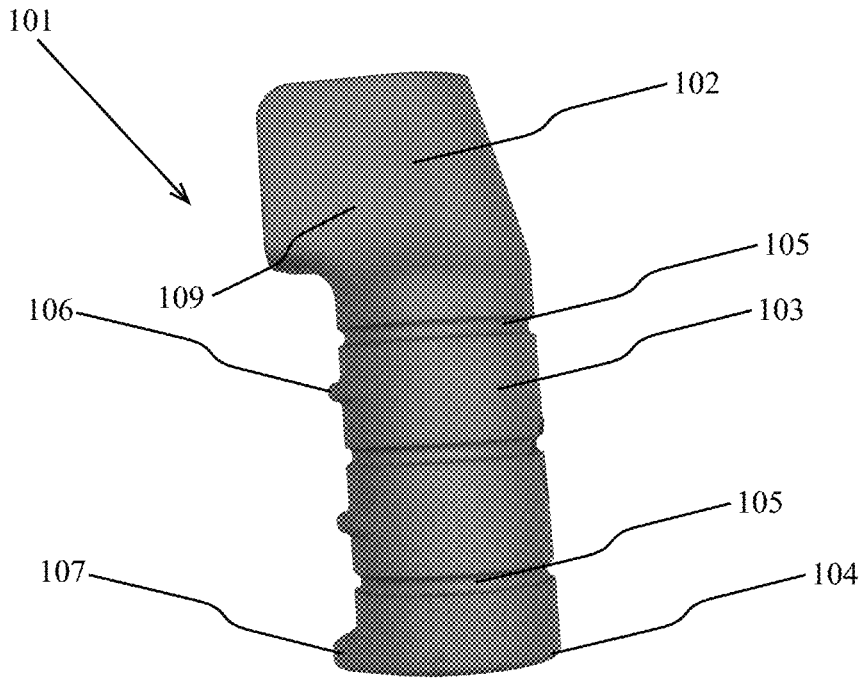
FIG. 1 is a photograph showing a left side view of a hand grip, according to some aspects.

It will be readily understood that the components of the embodiments as generally described herein and illustrated in the appended figures could be arranged and designed in a wide variety of different configurations. Thus, the following more detailed description of various embodiments, as represented in the figures, is not intended to limit the scope of the present disclosure, but is merely representative of various embodiments. While the various aspects of the embodiments are presented in drawings, the drawings are not necessarily drawn to scale unless specifically indicated.

The present invention may be embodied in other specific forms without departing from its spirit or essential characteristics. The described embodiments are to be considered in all respects only as illustrative and not restrictive. The scope of the invention is, therefore, indicated by the appended claims rather than by this detailed description. All changes which come within the meaning and range of equivalency of the claims are to be embraced within their scope.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussions of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize, in light of the description herein, that the invention can be practiced without one or more of the specific features or advantages of a particular embodiment. In other instances, additional features and advantages may be recognized in certain embodiments that may not be present in all embodiments of the invention.

Reference throughout this specification to "one embodiment", "an embodiment", or similar language means that a particular feature, structure, or characteristic described in connection with the indicated embodiment is included in at least one embodiment of the present invention. Thus, the phrases "in one embodiment", "in an embodiment", and similar language throughout this specification may, but do not necessarily, all refer to the same embodiment.

The early members of the M4 firearm family (e.g., AR-15 rifle, M16 carbine, etc.) had hard plastic hand grips. Improved hand grips, such as the famed beaver tail hand grip offered by Falcon Industries, Inc., became available decades later. The improved hand grips were among the first parts that were designed for upgrading and customizing M4 family firearms. Since that time, new accessories have been brought to market to meet the needs of the firearm users. Those accessories have included stocks, fore grips, optics, lasers, trigger assemblies, and new hand grip designs.

A new type of hand grip that has a cylindrical body, circumferential grooves, digit ridges, and a digit rest has been developed to meet the needs of certain long-range marksmen. In testing, cylindrical bodies with an outer diameter ranging from 1.25" and less than 1.55" have performed well with many users preferring a 1.4" outer diameter. Grooves in the cylindrical bodies provide improved grip. The digit ridges and digit rest are positioned such that the user's hand fits comfortably on the hand grip. The digit ridges are positioned to support individual fingers while the digit rest supports the lowest finger. One of the requirements for high accuracy shooting is that the user's body is comfortable and relaxed. The hand grip described herein is designed such that the user's hand can hold the grip in a comfortable and relaxed manner. Thereby improving accuracy.

Figure 2:
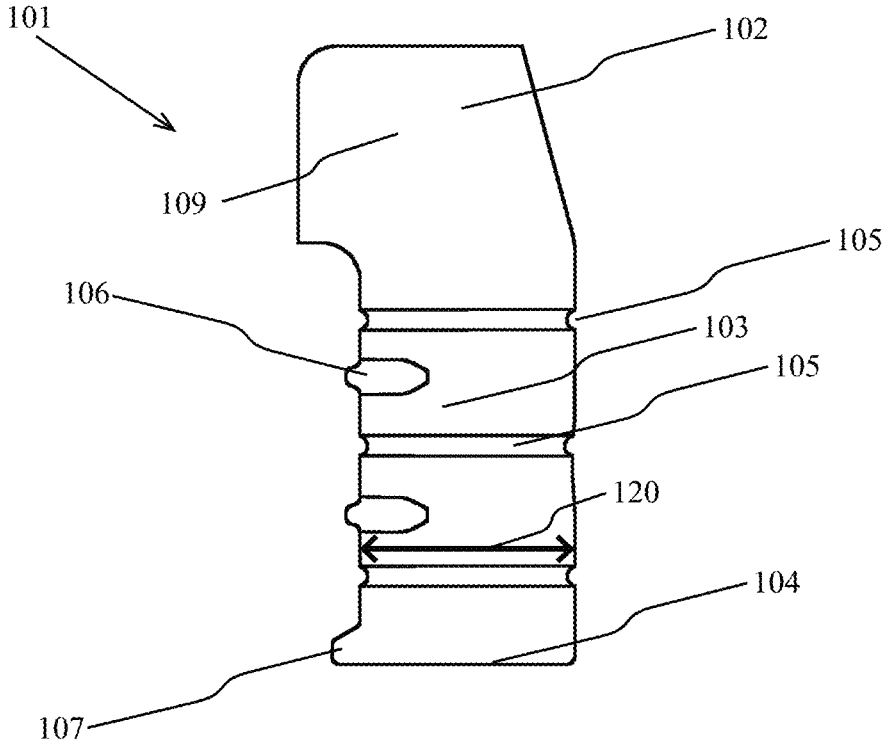
FIG. 2 is a line drawing illustrating a left side view of a hand grip, according to some aspects.

FIG. 1 is a photograph showing a left side view of a hand grip 101, according to some aspects. FIG. 2 is a line drawing illustrating a left side view of a hand grip 101, according to some aspects. The hand grip 101 has a top section 102, a cylindrical body 103, and a bottom 104. The left cheek 109 of the top section can be seen. The cylindrical body is substantially cylindrical in shape. The hand grip in FIGS. 1 and 2 has a cylindrical body with an outer diameter of approximately 1.4 inches, which has proven to be an excellent fit for the hands of many people. In practice, outer diameters within the range of 1.25 inches and 1.55 inches result in well performing hand grips. For example, FIG. 1 shows a hand grip 101 with a cylindrical body that has an outer diameter of 1.4 inches which is an outer diameter greater than 1.25 inches and less than 1.55 inches. The cylindrical body 103 is shown with three circumferential grooves 105. The circumferential grooves 105 in the illustration are parallel to each other and completely encircle the cylindrical body 103. A circumferential groove 105 completely encircling the cylindrical body 103 passes completely around the cylindrical body 103. The illustrated circumferential grooves 105 are approximately 0.04 inches deep and semi circular in shape. Testing indicates that grooves having a depth greater than 0.03 inches work well for providing a useful yet comfortable grip. The circumferential grooves 105 help improve the user's grip. The hand grip 101 is shown with digit ridges 106 between the circumferential grooves. The digit ridges are sized and positioned to fit between a user's fingers while the user is grasping the hand grip. The hand grip 101 is also shown with a digit rest 107 located at the bottom 104 and on the front surface of the cylindrical body 103. The digit rest 107 is sized and positioned to fit comfortably under and in contact with the user's hand. The hand grip 101 shown in FIGS. 1-2 is a monolithic hand grip and is therefore a single piece of material formed as a hand grip. FIGS. 1-2 also show that the bottom 104 is the bottom of the cylindrical body 103 and also the bottom of the hand grip 101.

Figure 3:
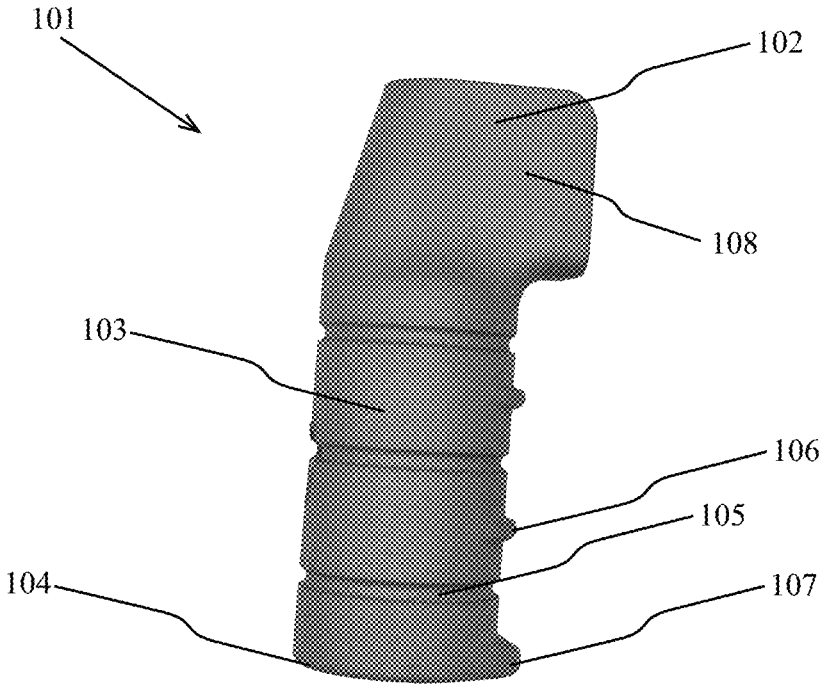
FIG. 3 is a photograph showing a right side view of a hand grip, according to some aspects.
Figure 4:
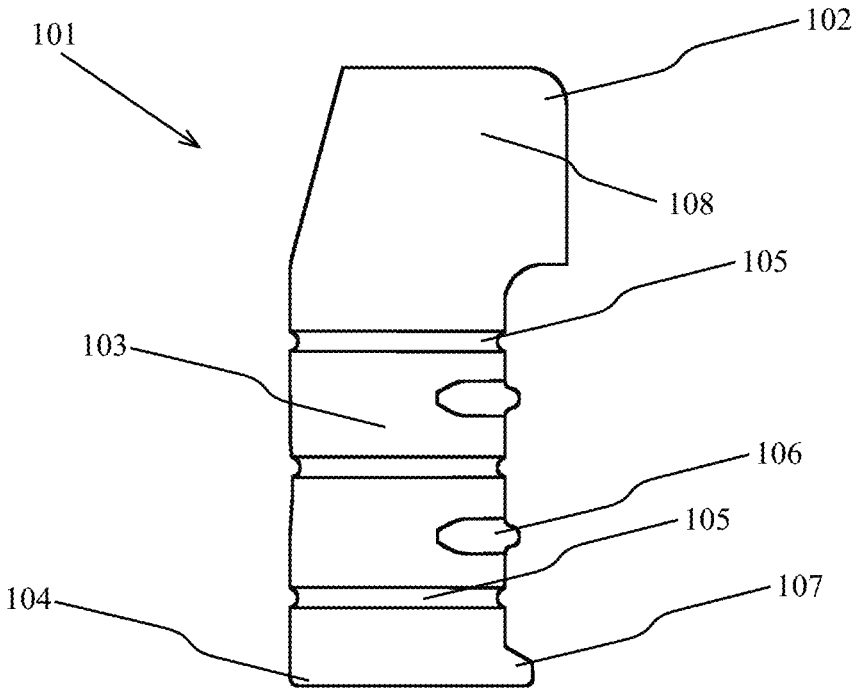
FIG. 4 is a line drawing illustrating a right side view of a hand grip, according to some aspects.

FIG. 3 is a photograph showing a right side view of a hand grip 101, according to some aspects. FIG. 4 is a line drawing illustrating a right side view of a hand grip 101, according to some aspects. The right cheek 108 of the top section 102 can be seen. The right side view shows the cylindrical body 103, circumferential grooves 105, digit ridges 106, digit rest 107, and other aspects from a different angle. Each of the digit ridges 106 is between two of the circumferential grooves. 105. A digit ridge can be equidistant between two circumferential grooves 105. For example, the distance from a digit ridge to a first circumferential groove can be equal to the distance from the digit ridge to a second circumferential groove.

Figure 5:
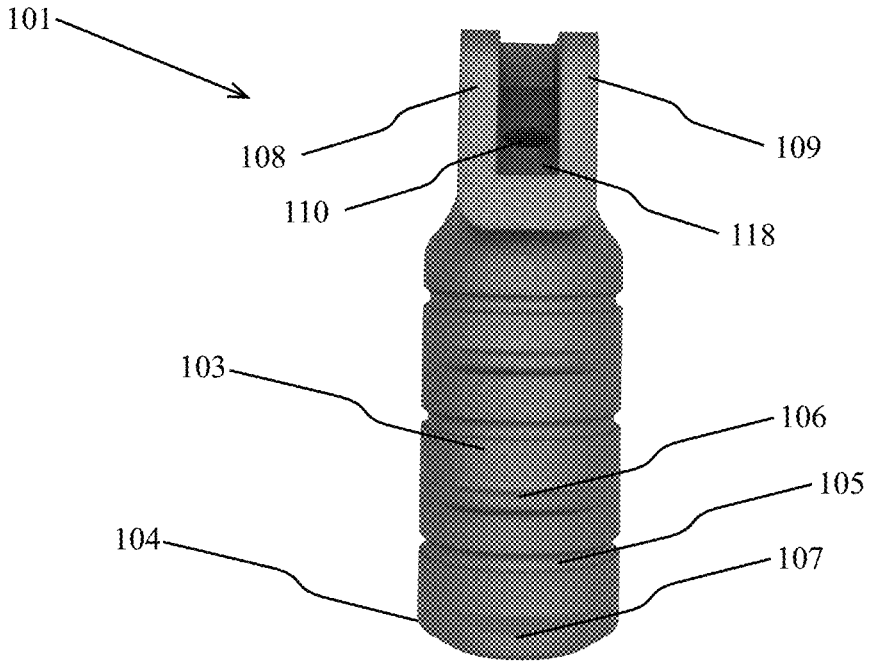
FIG. 5 is a photograph showing a front side view of a hand grip, according to some aspects.
Figure 6:
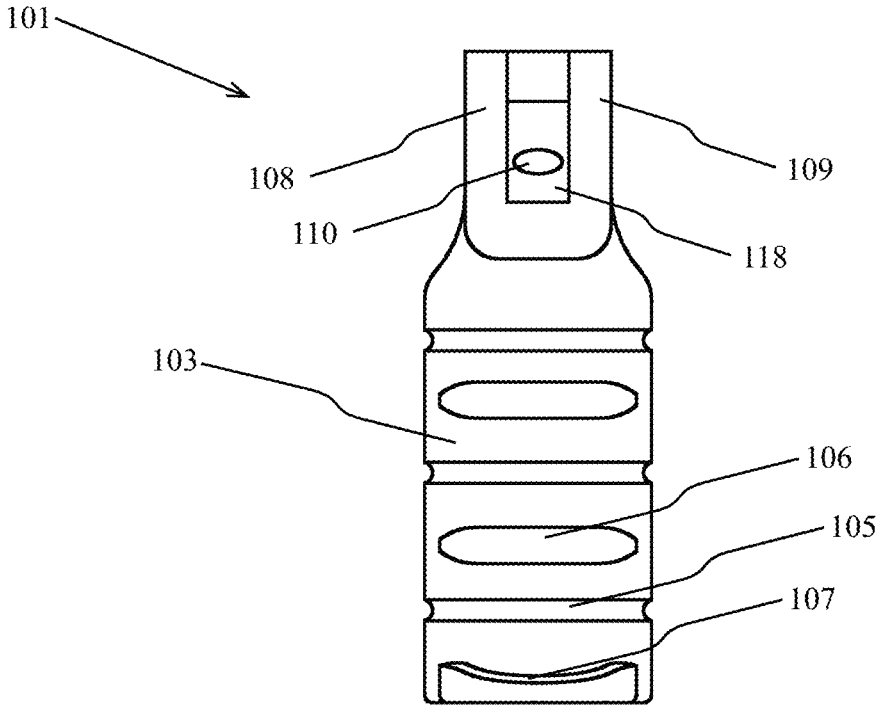
FIG. 6 is a line drawing illustrating a front side view of a hand grip, according to some aspects.

FIG. 5 is a photograph showing a front side view of a hand grip 101, according to some aspects. FIG. 6 is a line drawing illustrating a front side view of a hand grip 101, according to some aspects. The front side view shows the cylindrical body 103, circumferential grooves 105, digit ridges 106, digit rest 107, and other aspects from a different angle. The left cheek 109, receiver interface 118, and the right cheek 108 of the top section 102 can be seen. The left cheek 109, receiver interface 118, and the right cheek 108 of the illustrated hand grip are sized to precisely fit the lower receiver of an M4 family firearm. Those practiced in firearms are familiar with the firearm receiver of M4 family firearms and are aware the receiver consists of an upper receiver and a lower receiver, and that the lower receiver has a threaded hole for a grip screw. The receiver interface 118 has a grip screw hole 110. A grip screw passing through the grip screw hole 110 can be threaded into a threaded hole in a firearm receiver to thereby attach the hand grip to the receiver. As such, the hand grip is configured for attachment to a firearm such as an M4 family firearm.

Figure 7:
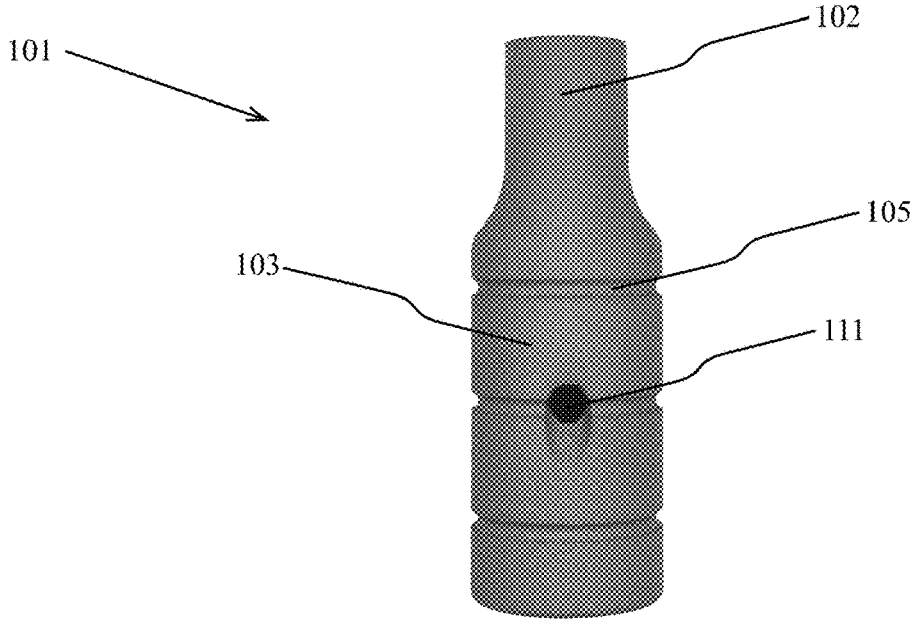
FIG. 7 is a photograph showing a back side view of a hand grip, according to some aspects.
Figure 8:
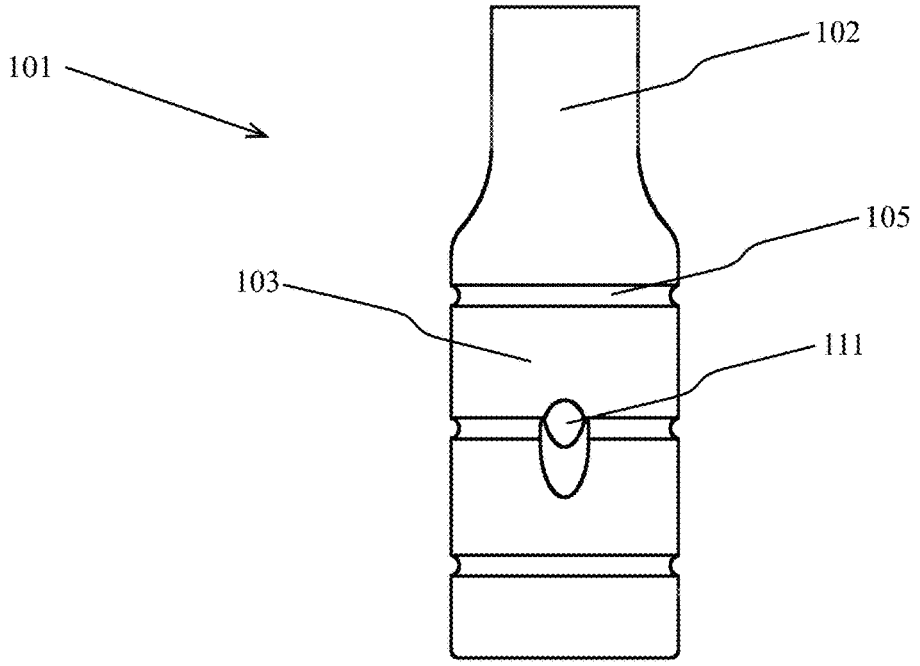
FIG. 8 is a line drawing illustrating a back side view of a hand grip, according to some aspects.

FIG. 7 is a photograph showing a back side view of a hand grip, according to some aspects. FIG. 8 is a line drawing illustrating a back side view of a hand grip, according to some aspects. The back side view shows the cylindrical body 103, circumferential grooves 105, and other aspects from a different angle. An access hole 111 can be seen in the rear surface of the cylindrical body. The access hole 111 is positioned and angled such that a tool can be passed through the back of the cylindrical body and used to turn the grip screw. The grip screw can thereby be tightened to attach the hand grip to the receiver or can be loosened to thereby remove the hand grip from the receiver.

Figure 9:
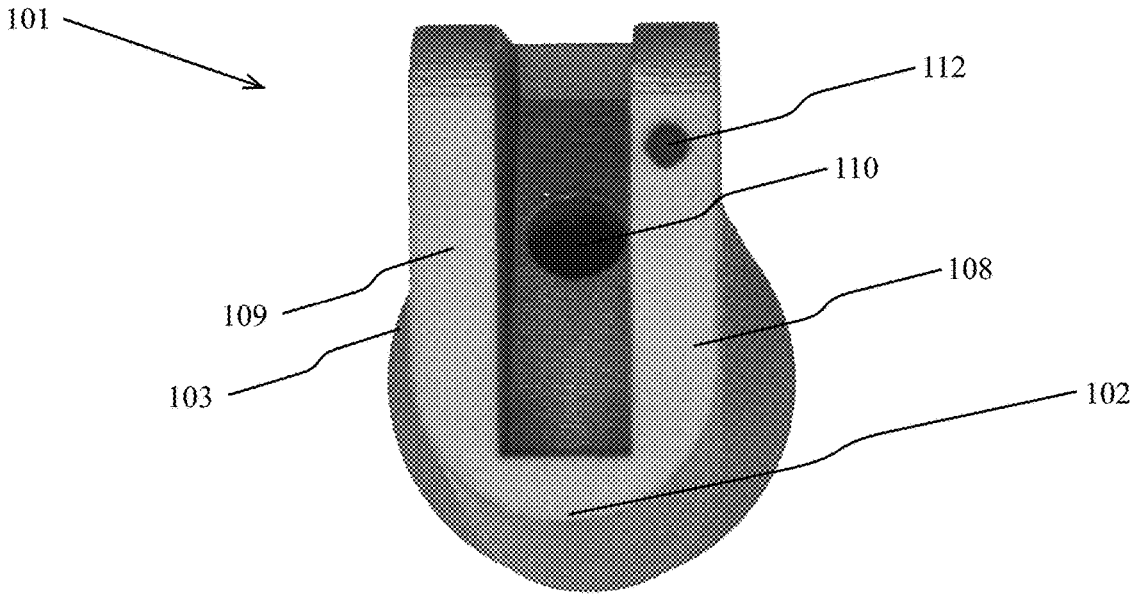
FIG. 9 is a photograph showing a top view of a hand grip, according to some aspects.
Figure 10:
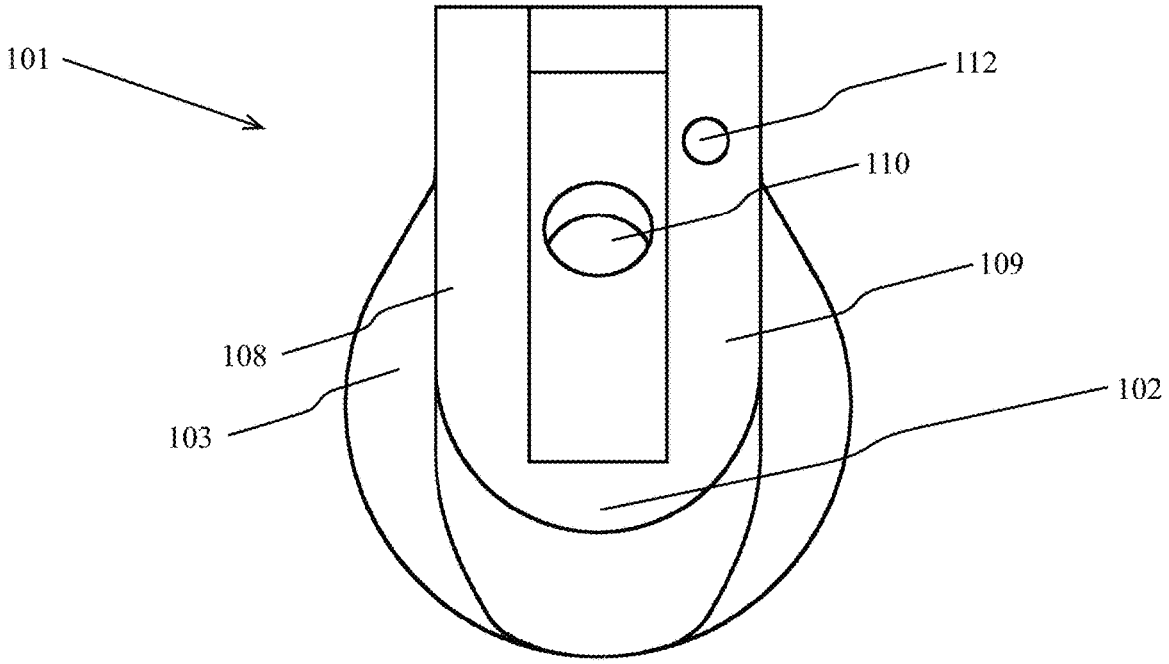
FIG. 10 is a line drawing illustrating a top view of a hand grip, according to some aspects.

FIG. 9 is a photograph showing a top view of a hand grip, according to some aspects. FIG. 10 is a line drawing illustrating a top view of a hand grip, according to some aspects. The top view shows the top section 102, cylindrical body 103, left cheek 109, receiver interface 118, right cheek 108 grip screw hole 110, and other aspects from a different angle. In addition, a blind hole 112 in the right cheek 108 of the top section 102 can be seen. Many M4 family firearms have a safety/fire control selector. The selector has detents. The blind hole is configured to hold a safety detent spring such that a safety detent spring in the blind hole can press a safety detent into the selector to thereby hold the selector in place. Those familiar with M4 family firearms know of the selector, safety detent, and safety detent spring.

Figure 11:
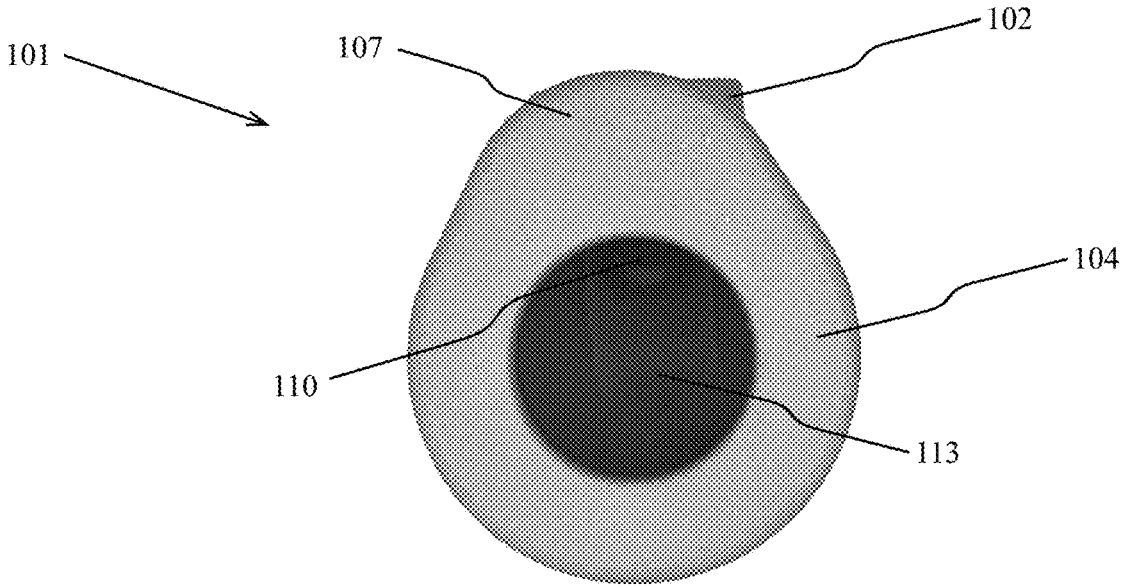
FIG. 11 is a photograph showing a bottom view of a hand grip, according to some aspects.
Figure 12:
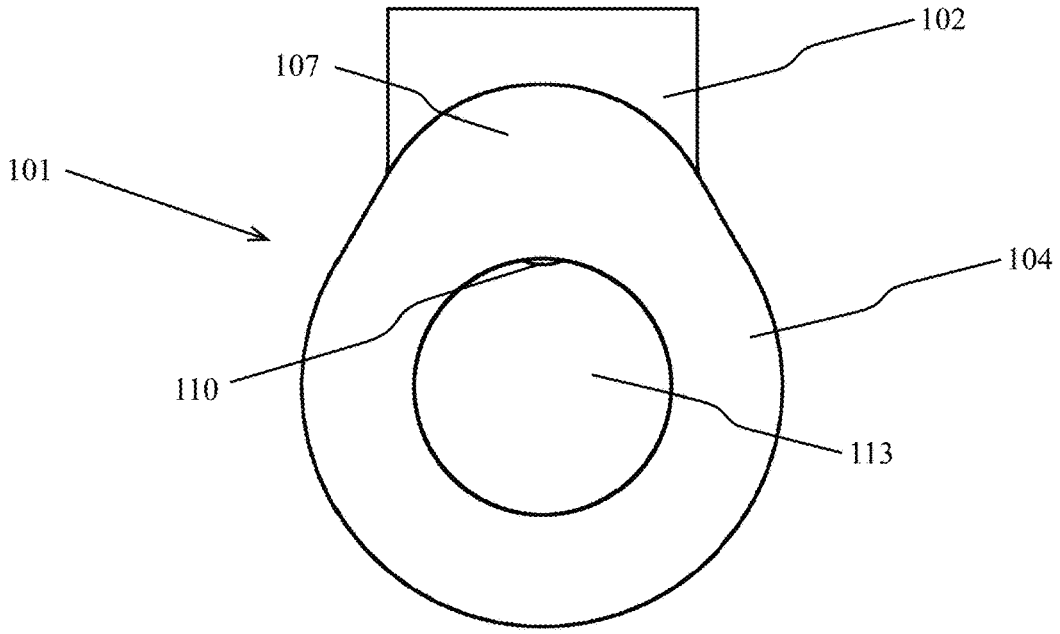
FIG. 12 is a line drawing illustrating a bottom view of a hand grip, according to some aspects.

FIG. 11 is a photograph showing a bottom view of a hand grip 101, according to some aspects. FIG. 12 is a line drawing illustrating a bottom view of a hand grip 101, according to some aspects. The bottom view shows the bottom 104, digit rest 107, grip screw hole 110, top section 102, and other aspects from a different angle. In addition, a bottom hole 113 can be seen.

Figure 13:
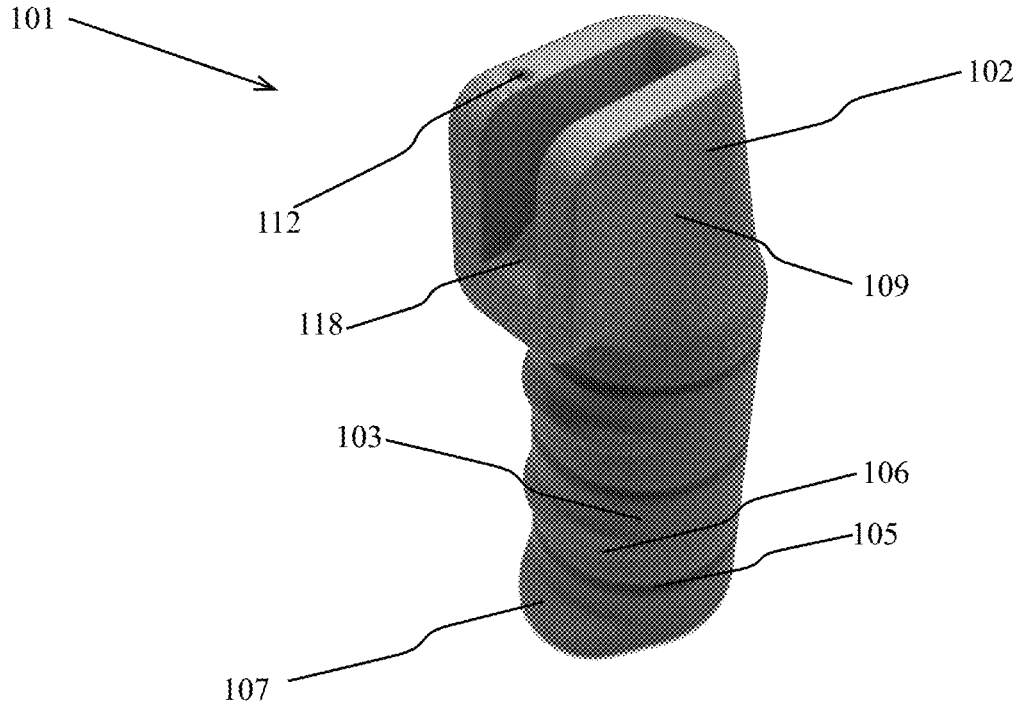
FIG. 13 is a photograph showing a top left view of a hand grip, according to some aspects.
Figure 14:
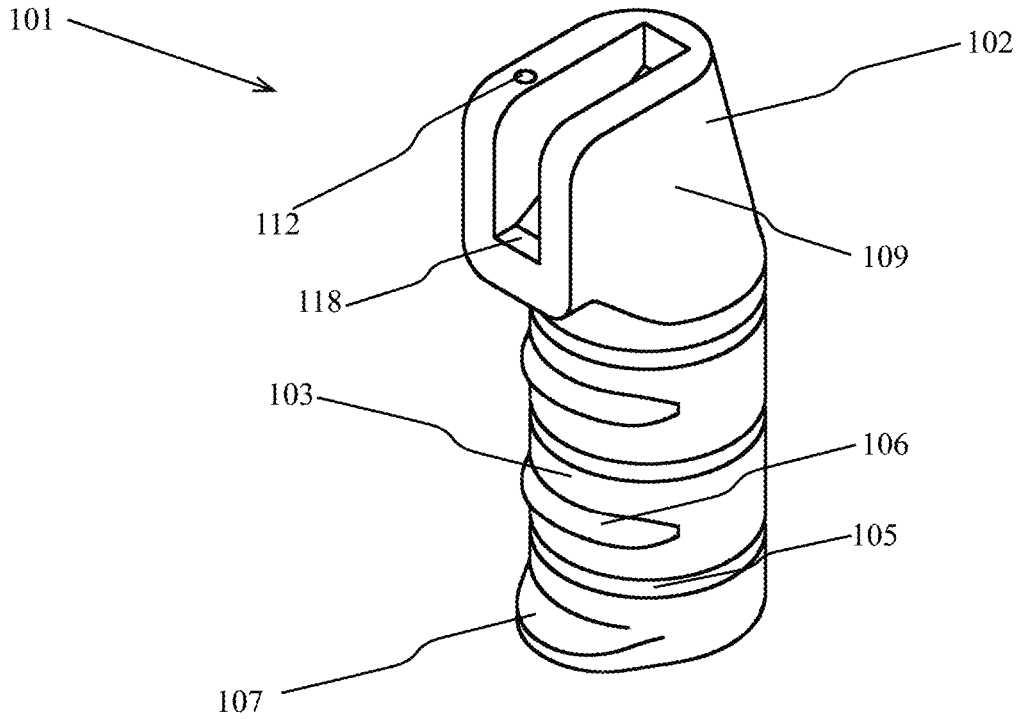
FIG. 14 is a line drawing illustrating a top left view of a hand grip, according to some aspects.

FIG. 13 is a photograph showing a top left view of a hand grip 101, according to some aspects. FIG. 14 is a line drawing illustrating a top left view of a hand grip 101, according to some aspects. The top left view shows the top section 102, cylindrical body 103, circumferential grooves 105, digit ridges 106, digit rest 107, blind hole 112, left cheek 109, receiver interface 118, and other aspects from a different angle.

Figure 15:
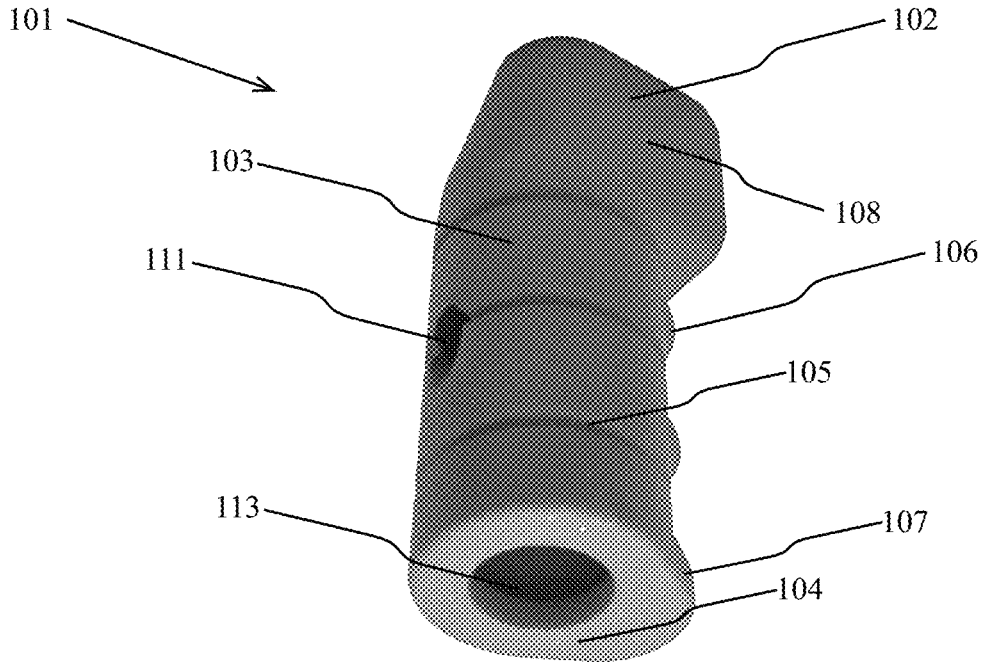
FIG. 15 is a photograph showing a bottom right view of a hand grip, according to some aspects.
Figure 16:
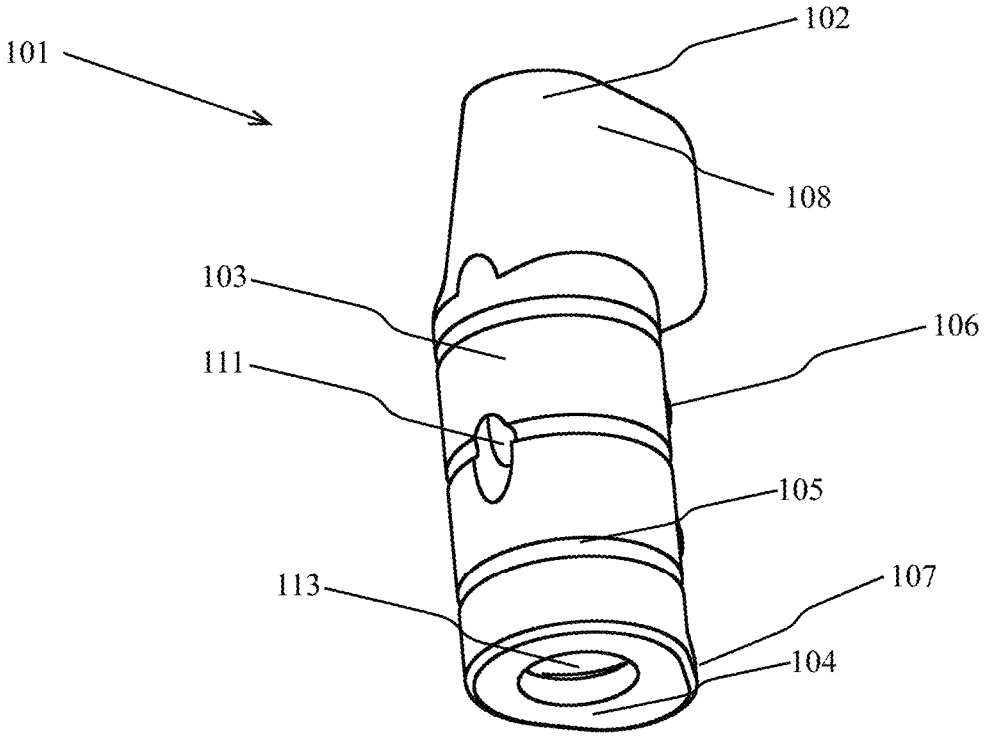
FIG. 16 is a line drawing illustrating a bottom right view of a hand grip, according to some aspects.
Figure 17:
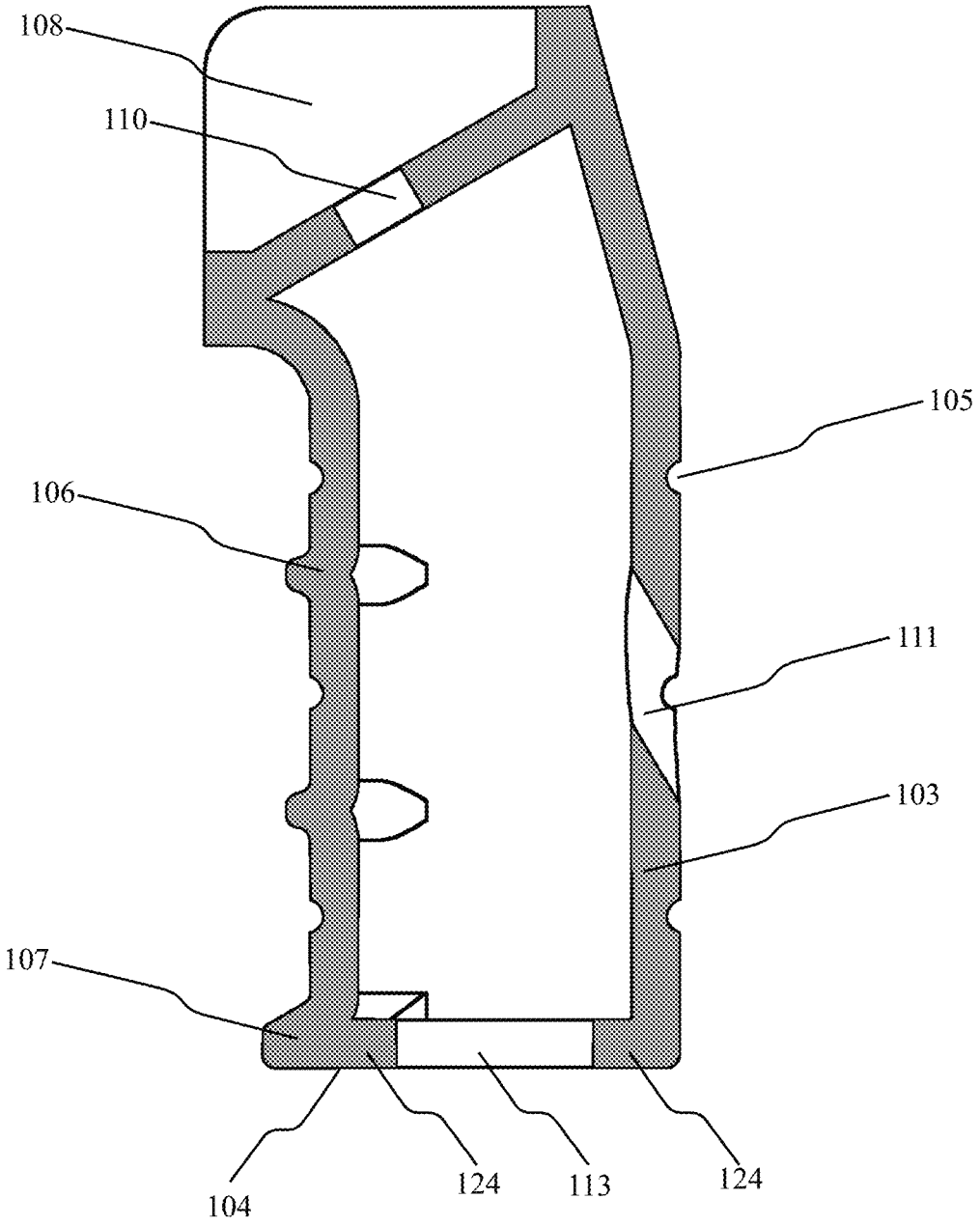
FIG. 17 is an illustration of a cut view of a hand grip, according to some aspects.

FIG. 15 is a photograph showing a bottom right view of a hand grip, according to some aspects. FIG. 16 is a line drawing illustrating a bottom right view of a hand grip, according to some aspects. The bottom right view shows the top section 102, cylindrical body 103, circumferential grooves 105, digit ridges 106, digit rest 107, access hole 111, right cheek 108, receiver interface 118, bottom hole 113, and other aspects from a different angle FIG. 17 is an illustration of a cut view of a hand grip, according to some aspects. The right cheek 108 and grip screw hole 110 can be seen. The access hole 111 can be seen to be angled such that a tool can reach the head of a grip screw in the grip screw hole 110. A bottom ridge 124 can be seen extending inward from the cylindrical body 103 along the bottom 104. The bottom ridge 124 adds rigidity to the bottom 104 of the hand grip 101.

Figure 18:
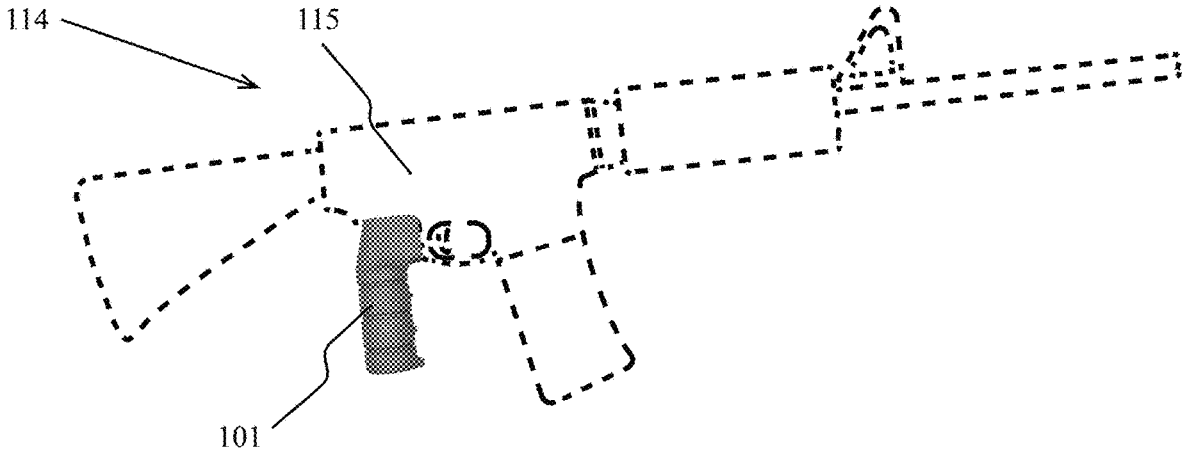
FIG. 18 is an illustration of a hand grip on an M4 family firearm, according to some aspects.

FIG. 18 is an illustration of a hand grip 101 on an M4 family firearm 114, according to some aspects. The M4 family of firearms is notoriously well known around the world and is used by many of the world's militaries. M4 family firearms have receivers with standardized dimensions such that accessories, such as hand grips, are interchangeable and upgradeable. The hand grip 101 of FIG. 18 is sized and formed to fit the receiver 115 of M4 family firearms. The receiver 115 consists of an upper receiver and a lower receiver. Hand grips attach to the lower receiver.

Figure 19:
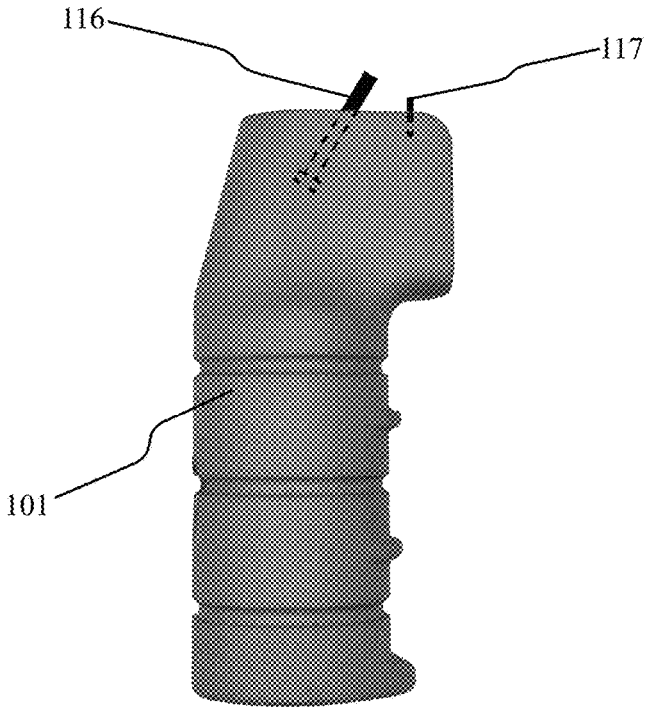
FIG. 19 is an illustration of a hand grip with a detent spring and a grip screw, according to some aspects.
Figure 20:
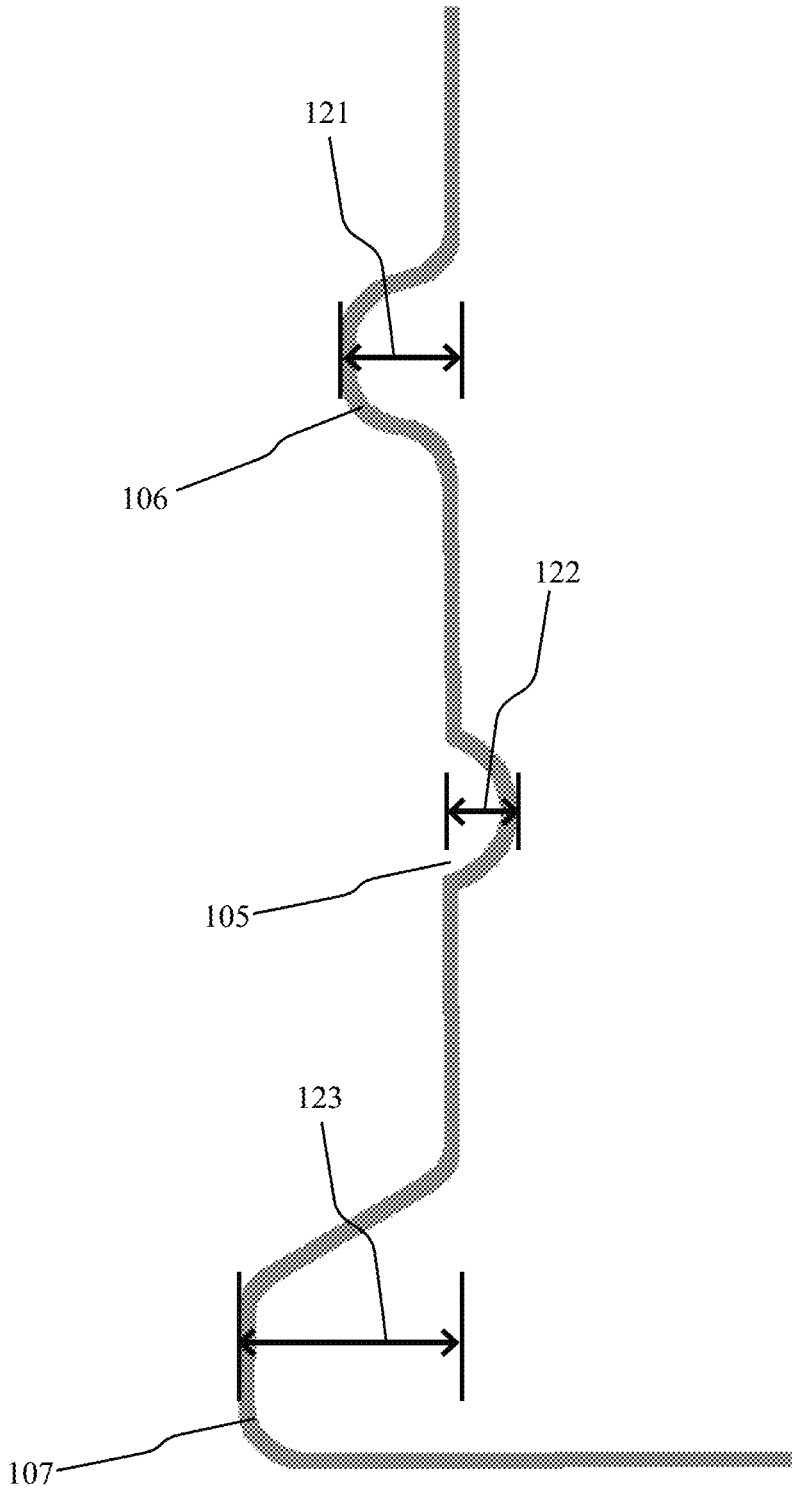
FIG. 20 is an illustration showing dimensions of a digit ridge, a groove, and a digit rest, according to some aspects.

FIG. 19 is an illustration of a hand grip 101 with a detent spring 117 and a grip screw 116, according to some aspects. The grip screw passes through the grip screw hole. The threaded end of the grip screw 116 can be threaded into a threaded hole in the lower receiver. The head end of the grip screw 116 is inside the hand grip 101. The detent spring 117 is in the blind hole 112. The blind hole 112 can line up with a hole in the lower receiver such that the detent spring can press a safety detent into a safety selector that is installed in the receiver. Those familiar with M4 family firearms are familiar with the detent spring 117, grip screw 116, safety detent, and safety selector FIG. 20 is an illustration showing dimensions of a digit ridge 106, a circumferential groove 105, and a digit rest 107, according to some aspects. The digit ridge 106 extends outward from the cylindrical body 103 by a digit ridge offset distance 121. The hand grip 101 of FIGS. 1-17 has a digit ridge offset distance 121 of approximately 0.085 inches. The digit rest 107 extends outward from the cylindrical body 103 by a digit rest offset distance 123. The hand grip 101 of FIGS. 1-17 has a digit rest offset distance 123 of approximately 0.18 inches. The circumferential groove 105 extends into the cylindrical body by a groove depth 122. The hand grip 101 of FIGS. 1-17 has a groove depth 122 of approximately 0.043 inches. As such, the cylindrical body 103 has a circumferential groove that is at least 0.03" deep. FIG. 20 shows a circumferential groove 105 that has a semicircular shape. The dimensions of the hand grip 101 of FIGS. 1-17 have been selected because they work well for a variety of firearm users.

Figure 21:
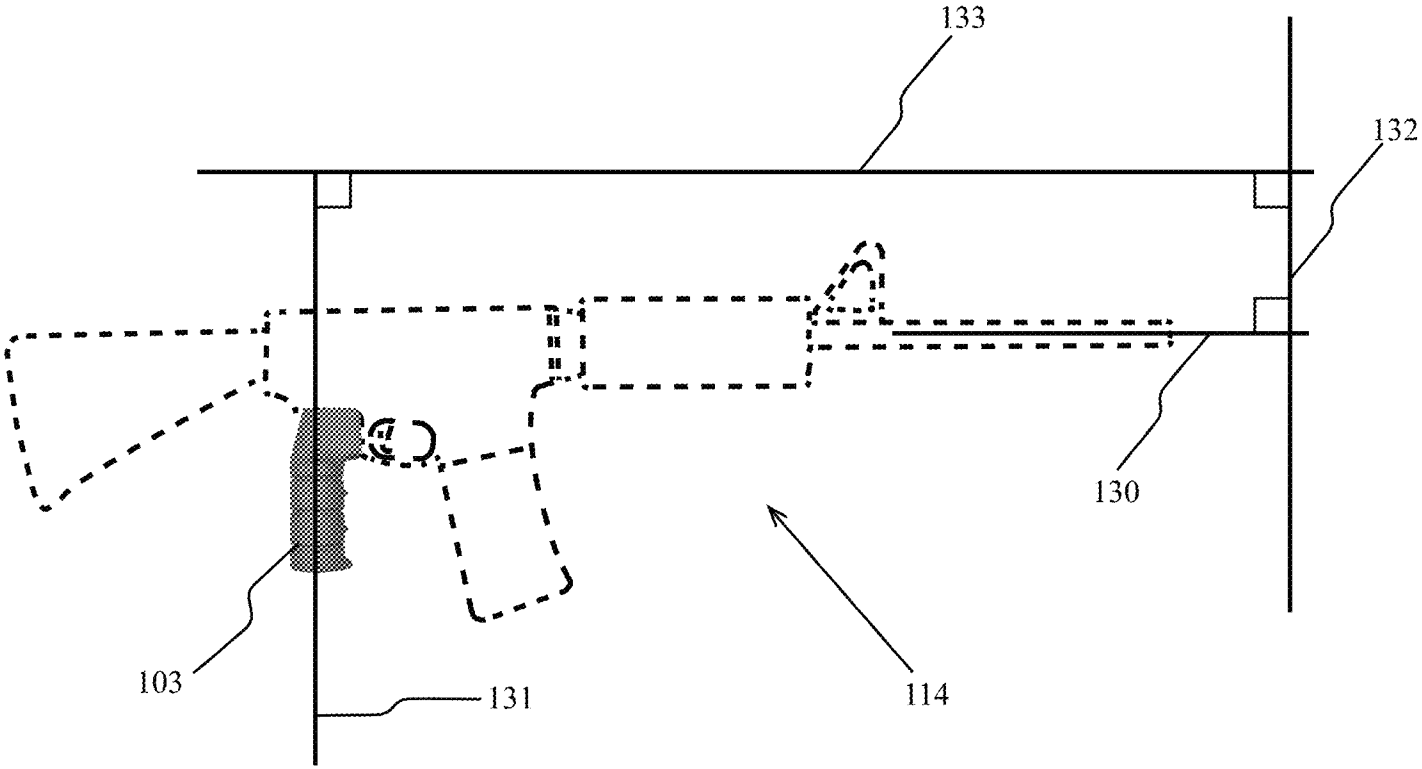
FIG. 21 is an illustration showing that the central axis of the cylindrical body is perpendicular to the bore line of the firearm.

FIG. 21 is an illustration showing that the central axis 130 of the cylindrical body 103 can be perpendicular to the bore line 130 of the firearm 114. The prior art grips for M4 family firearms have handgrips that are angled approximately 60 degrees relative to the bore line 130. In fact, the prior art hand grips do not have an access hole such as access hole 111 because a tool passing through the bottom of a prior art hand grip can access the grip screw 116. The hand grip illustrated in FIGS. 1-21 does not provide such convenient straight-line access through the bottom to the grip screw because of the angle of the cylindrical body 103 relative to the firearm. As such, an access hole 111 in the back surface of the cylindrical body 103 can be provided. The grip screw 116 can be turned by a tool passing through the access hole 111. The perpendicular body 103 of the hand grip 101 may be more comfortable for long range marksmanship than prior art hand grips are. The M4 family firearms are designed primarily as carbines and the prior art hand grips have proven excellent for use on carbines. Carbines are generally not considered to be accurate long range rifles. An M4 family firearm can be customized for long range marksmanship by, among other things, fitting a specialized hand grip (e.g., hand grip 101) to the firearm.

The cylindrical body 103 is a perpendicular body because the axis 131 of the cylindrical body 103 is perpendicular to the bore line 130. The bore line 130 is the line passing along the center of the bore of the firearm's barrel. Cylinders have an axis of rotation that passes through the center of the cylinder. The cylindrical body 103 therefore has an axis of rotation that herein is called the axis 131 of the of the cylindrical body 103. For clarity, a first markup line 132 and a second markup line 133 are used to show that the axis 131 of the cylindrical body 103 is perpendicular to the bore line 130. The first markup line 132 is perpendicular to the bore line 130 and to the second markup line 133. The second markup line 133 is therefore parallel to the bore line 130. The axis 131 of the cylindrical body 103 is perpendicular to the second markup line 133 and is therefore also perpendicular to the bore line 130. The angle of the grip is designed to be perpendicular to the bore axis of the host firearms. This aids shooters that use this grip for long range/precision style shooting techniques where the thumb is not wrapped around the grip but left in line with the other 4 digits. This allows shooter to maintain the same hold on their pistol gripped guns as they would on a gun with a traditional gunstock. The grip can also be utilized on compact type guns, where the length of pull is kept extremely short. When the length of pull of a firearm is shorter than the natural length of pull on a shooter, the traditional swept back angle of a grip is too steep and requires the shooter to bend the wrist forward at an unnatural angle.

It will be appreciated that variations of the above-disclosed and other features and, functions, or alternatives thereof, may be desirably combined into many other different systems or applications. Also, that various presently unforeseen or unanticipated alternatives, modifications, variations or improvements therein may be subsequently made by those skilled in the art which are also intended to be encompassed by the following claims.

What is claimed is:

1. A hand grip comprising:
a cylindrical body;
a top section that includes a right cheek, a left cheek, and a receiver interface between the right cheek and the left cheek;
a grip screw hole in the receiver interface; and
a bottom,
wherein
the cylindrical body is between the top section and the bottom,
the grip screw hole is configured for a grip screw to pass through the grip screw hole and to thread into a threaded hole in a lower receiver of a M4 family firearm,
the grip screw hole is configured for the grip screw to attach the hand grip to a firearm receiver,
the hand grip is configured as a M4 family firearm hand grip, and
the hand grip is a single piece of material.

2. The hand grip of claim 1, further including:
an access hole in the cylindrical body and in a rear surface of the hand grip,
wherein
the access hole is configured to provide access to the grip screw.

3. The hand grip of claim 1, wherein the cylindrical body has an outer diameter that is greater than 1.25" and less than 1.55".

4. The hand grip of claim 1, wherein the cylindrical body has a circumferential groove that is at least 0.03" deep.

5. The hand grip of claim 1, wherein the bottom includes a digit rest that is located on a front surface of the hand grip.

6. The hand grip of claim 1, wherein the top section includes a blind hole configured for holding a safety detent spring of the M4 family firearm.

7. The hand grip of claim 1, wherein the cylindrical body includes a plurality of circumferential grooves.

8. The hand grip of claim 7, wherein the circumferential grooves are parallel.

9. The hand grip of claim 7, wherein one of the circumferential grooves passes completely around the cylindrical body.

10. The hand grip of claim 1, wherein the hand grip is a monolithic hand grip.

11. The hand grip of claim 1, further including a digit ridge, wherein:

the digit ridge is located between the bottom and the top section; and the digit ridge is located on a front surface of the hand grip.

12. The hand grip of claim 11, wherein:

the cylindrical body includes two parallel circumferential grooves; and the digit ridge is positioned between the two parallel circumferential grooves.

13. The hand grip of claim 12, wherein:

the cylindrical body has an axis;

the M4 family firearm has a bore line; and the hand grip is configured for attachment to the M4 family firearm with the axis of the cylindrical body perpendicular to the bore line.

14. The hand grip of claim 13, further including:

a digit rest that is located at the bottom of and on the front surface of the hand grip;

an access hole in the cylindrical body and passing through a rear surface of the hand grip; and a blind hole in the top section, wherein the access hole is configured to provide access to the grip screw, the cylindrical body has an outer diameter that is greater than 1.25" and less than 1.55", the two parallel circumferential grooves are at least 0.03" deep, the blind hole is configured for holding a safety detent spring of the M4 family firearm, and the hand grip is a monolithic hand grip.

15. The hand grip of claim 1, wherein:

the cylindrical body is circularly symmetric about an axis; and the bottom is flat and angled normal to the axis.

16. A method comprising:

forming a single piece of material as a hand grip for an M4 family firearm, the hand grip including a cylindrical body, a top section, and a bottom, wherein the top section includes a right cheek, a left cheek, and a receiver interface between the right cheek and the left cheek, the receiver interface has a grip screw hole that is configured for a grip screw to pass through the grip screw hole and to thread into a threaded hole in a lower receiver of the M4 family firearm to thereby attach the hand grip to the M4 family firearm, the cylindrical body is between the top section and the bottom.

17. The method of claim 16, wherein:

the cylindrical body includes a plurality of parallel circumferential grooves that completely encircle the cylindrical body.

18. The method of claim 16, wherein the hand grip includes a digit rest that is located at the bottom and on a front surface of the hand grip.

19. A hand grip comprising:

an attachment means for attaching the hand grip to a lower receiver of a M4 family firearm;

a cylindrical gripping means for gripping the hand grip, the cylindrical gripping means located under the attachment means; and an access means for accessing a grip screw attaching the hand grip to the M4 family firearm, the access means located in the cylindrical gripping means and in a rear surface of the hand grip, wherein:

the attachment means includes a blind hole that is configured for holding a safety detent spring of the M4 family firearm; and the hand grip is a single piece of material.

20. The hand grip of claim 19, wherein:

the cylindrical gripping means has a central axis;

M4 family firearm has a bore line; and the hand grip is configured for attachment to the M4 family firearm with the central axis perpendicular to the bore line.

* * * * *